US009770815B2

(12) United States Patent
Scrivens

(10) Patent No.: US 9,770,815 B2
(45) Date of Patent: Sep. 26, 2017

(54) GRIPPING SOCKET, WRENCH AND METHOD OF USE

(71) Applicant: Actuant Corporation, Menomonee Falls, WI (US)

(72) Inventor: Anthony Scrivens, Telford (GB)

(73) Assignee: Actuant Corporation, Menomonee Falls, WI (US)

( * ) Notice: Subject to any disclaimer, the term of this patent is extended or adjusted under 35 U.S.C. 154(b) by 295 days.

(21) Appl. No.: 14/415,104

(22) PCT Filed: Jul. 19, 2013

(86) PCT No.: PCT/US2013/051266
§ 371 (c)(1),
(2) Date: Jan. 15, 2015

(87) PCT Pub. No.: WO2014/015250
PCT Pub. Date: Jan. 23, 2014

(65) Prior Publication Data

US 2015/0209946 A1 Jul. 30, 2015

Related U.S. Application Data

(60) Provisional application No. 61/674,153, filed on Jul. 20, 2012.

(51) Int. Cl.
*B25B 23/10* (2006.01)
*B25B 13/06* (2006.01)

(52) U.S. Cl.
CPC ..... *B25B 23/108* (2013.01); *B25B 13/06* (2013.01); *Y10T 29/49963* (2015.01)

(58) Field of Classification Search
CPC ..... B25B 23/10; B25B 23/105; B25B 23/108; B25B 13/06; Y10T 29/49963; B23B 31/107
See application file for complete search history.

(56) References Cited

U.S. PATENT DOCUMENTS 2,220,354 A 11/1940 Sheetz
2,805,594 A 9/1957 Fogel
(Continued)

FOREIGN PATENT DOCUMENTS

CN 201086262 7/2008
CN 201098869 8/2008
(Continued)

OTHER PUBLICATIONS

Second Office Action from The State Intellectual Property Office of the Peoples Republic of China for Application No. 201380048050.0 dated Jun. 7, 2016 (21 pages).
(Continued)

*Primary Examiner* — David B Thomas
(74) *Attorney, Agent, or Firm* — Michael Best & Friedrich LLP

(57) ABSTRACT

A socket assembly for turning a fastener with a wrench has ball mechanisms that normally engage with sides of the fastener and that can be deactivated out of engagement with the fastener by turning a collar of the socket assembly. The socket includes a socket body having a fastener receiving opening sized and shaped to engage the fastener so as to drive the fastener rotationally. At least one ball opening is provided in the fastener receiving opening adjacent the fastener when the fastener is received in the opening. A ball is provided capable of partially protruding from the ball opening with the socket in an engaged state. A ball taper insert cams against the ball to push the ball into the ball opening. A spring biases the ball taper insert so as to urge the ball into the ball opening to engage the fastener.

18 Claims, 9 Drawing Sheets

(56) References Cited

U.S. PATENT DOCUMENTS

| | | | | |
|---|---|---|---|---|
| 3,286,749 | A | 11/1966 | Learned | |
| 4,237,946 | A * | 12/1980 | Leitner | B25B 23/10 279/75 |
| 5,323,672 | A | 6/1994 | Skiba | |
| 5,640,889 | A | 6/1997 | Anderson | |
| 6,889,581 | B2 | 5/2005 | Chen | |
| 7,246,542 | B2 | 7/2007 | Karol | |
| 7,752,946 | B2 * | 7/2010 | Wang | B25B 13/06 81/124.1 |
| 7,921,753 | B2 * | 4/2011 | Chen | B25B 13/06 81/444 |
| 2003/0029283 | A1 | 2/2003 | Yaar | |
| 2004/0050218 | A1 | 3/2004 | Napoli | |
| 2005/0034564 | A1 | 2/2005 | Albrecht | |
| 2006/0053981 | A1 | 3/2006 | Shaw et al. | |
| 2007/0193415 | A1 | 8/2007 | Isaacson | |
| 2008/0087140 | A1 | 4/2008 | Wang | |
| 2009/0019974 | A1 | 1/2009 | Streuli | |
| 2009/0078096 | A1 | 3/2009 | Ryall et al. | |
| 2009/0188349 | A1 | 7/2009 | Hanning et al. | |
| 2009/0235785 | A1 | 9/2009 | Kim | |
| 2009/0309316 | A1 | 12/2009 | Hu | |
| 2009/0314141 | A1 | 12/2009 | Weinstein et al. | |
| 2010/0005934 | A1 | 1/2010 | Guilbault | |
| 2010/0219593 | A1 | 9/2010 | Puzio et al. | |
| 2011/0024998 | A1 * | 2/2011 | Nieh | B23B 31/1071 279/81 |

FOREIGN PATENT DOCUMENTS

| | | |
|---|---|---|
| DE | 8428029 | 1/1985 |
| EP | 1312447 A2 | 5/2003 |
| GB | 2432805 | 6/2007 |
| TW | M290451 | 5/2006 |
| WO | 98/17440 A1 | 4/1998 |

OTHER PUBLICATIONS

Third Office Action from the State Intellectual Property Office of China for Application No. 201380048050.0 dated Nov. 22, 2016 (8 pages).

Office Action from the State Intellectual Property Office of China for Application No. 201380048050.0 dated Nov. 2, 2015 (18 pages).

PCT/US2013/051266 International Search Report and Written Opinion dated Dec. 20, 2013 (8 pages).

PCT/US2013/051266 International Preliminary Report on Patentability and Written Opinion of the International Searching Authority dated Jan. 29, 2015 (8 pages).

EP13820527.3 Extended European Search Report dated Jan. 16, 2016 (7 pages).

EP13820527.3 Examination Report dated Dec. 9, 2016 (5 pages).

* cited by examiner

FIG. 10
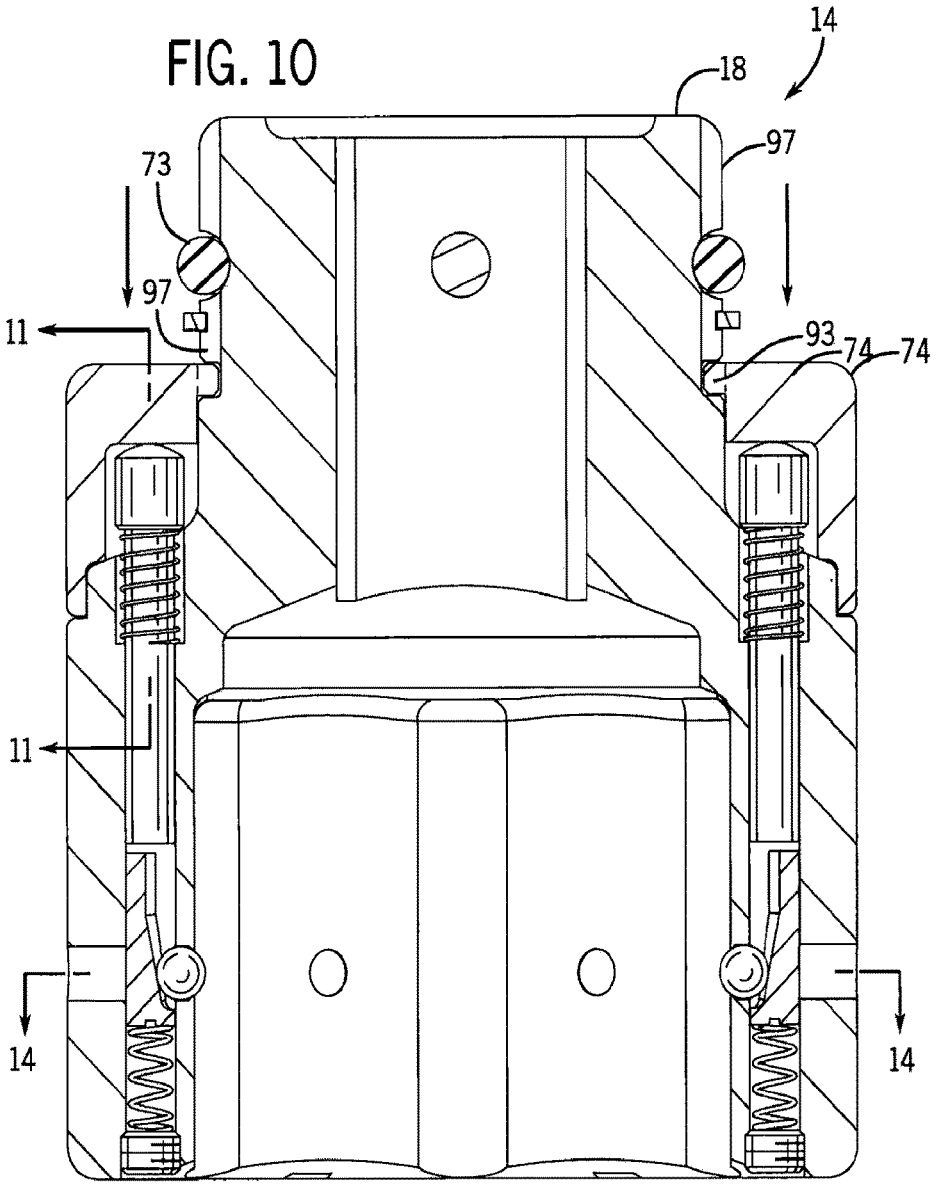
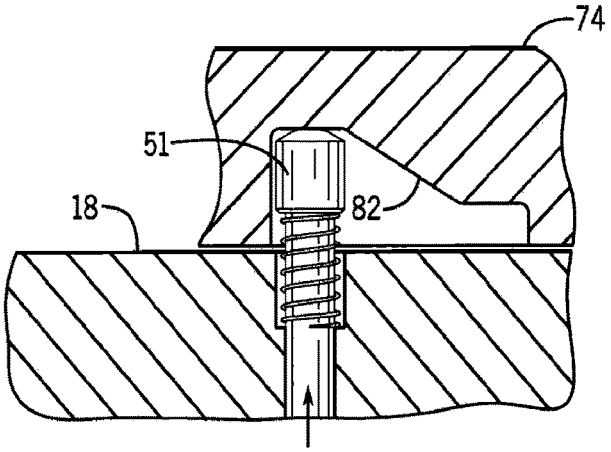
FIG. 11

FIG. 12
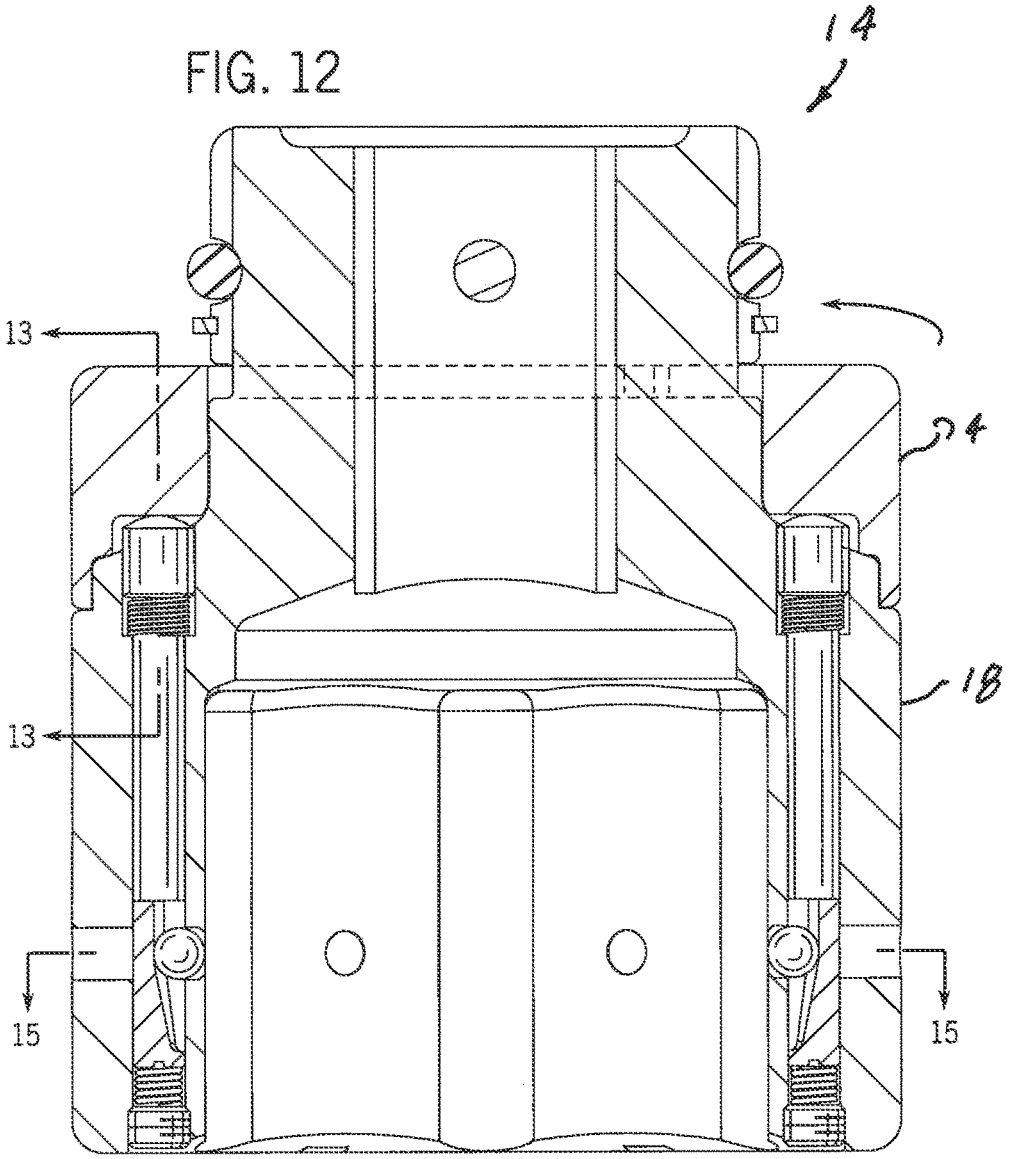
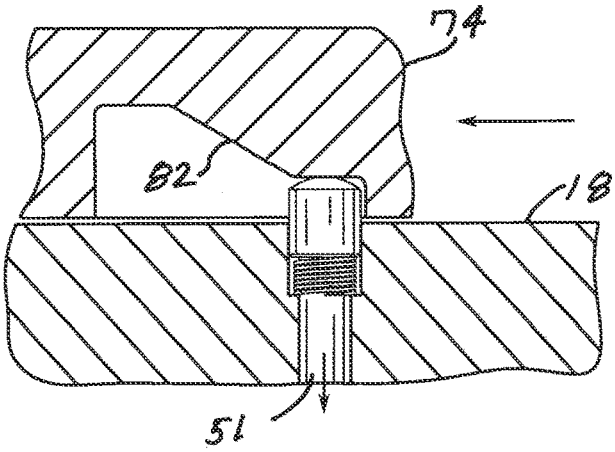
FIG. 13

FIG. 14
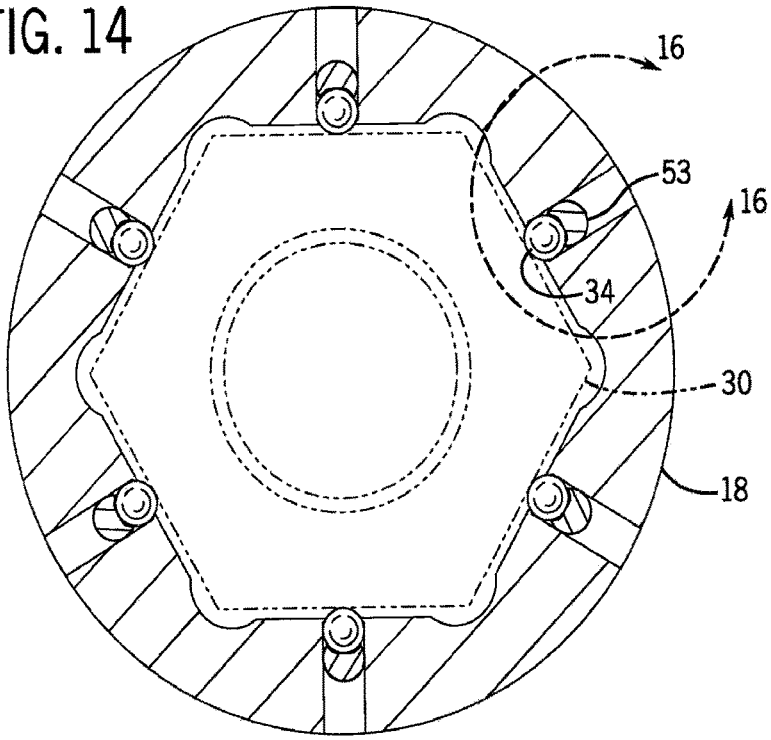
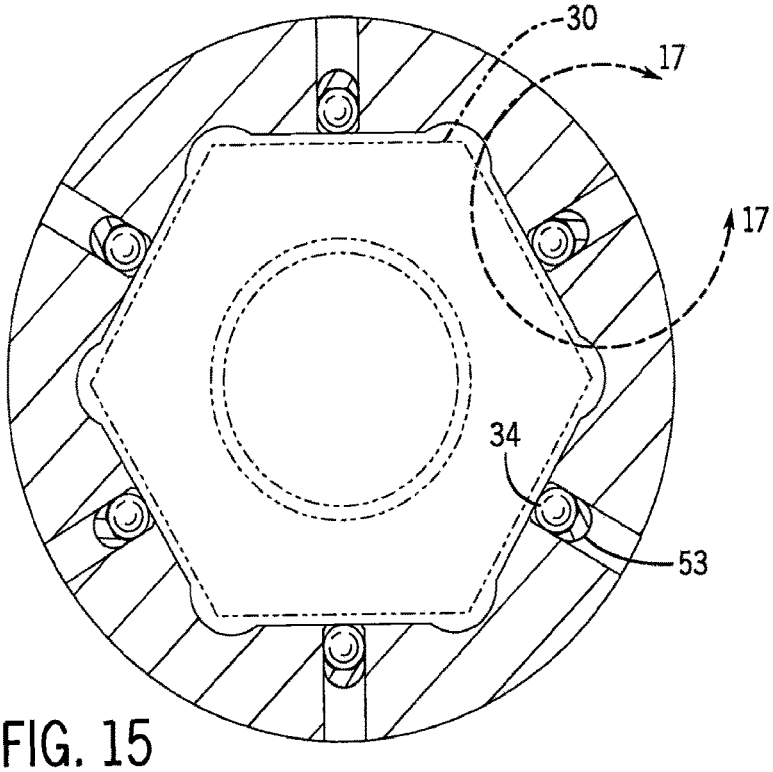
FIG. 15

GRIPPING SOCKET, WRENCH AND METHOD OF USE

CROSS-REFERENCE TO RELATED APPLICATIONS

This claims the benefit of U.S. Provisional Patent Application No. 61/674,153 tiled Jul. 20, 2012, the disclosure of which is hereby incorporated by reference for all purposes.

STATEMENT CONCERNING FEDERALLY SPONSORED RESEARCH OR DEVELOPMENT

Not applicable.

FIELD OF THE INVENTION

This invention relates to sockets for tightening fasteners, and in particular to a socket that has a mechanism for gripping a fastener so as to resist removal of the socket from the fastener.

BACKGROUND OF THE INVENTION

When applying torque to a fastener with a wrench, it can be difficult to keep the socket of the wrench engaged with the fastener. When the tool is heavy, it becomes even more difficult. if the tool is used in a high location, is remotely operated, and/or has external forces applied to it, for example by hydraulic hoses in the case of a hydraulic torque wrench, the problem is further exacerbated or secure engagement can become of critical importance. Accordingly, the present invention provides a mechanism for helping to hold a wrench socket on a fastener during a tightening or loosening operation.

SUMMARY OF THE INVENTION

The invention provides a socket for engaging a fastener so as to drive the fastener rotationally, the socket having a gripping mechanism to help maintain the socket engaged with the fastener. The socket includes a socket body having a fastener receiving opening sized and shaped to engage a fastener so as to drive the fastener rotationally. At least one ball opening is provided in the fastener receiving opening adjacent the fastener when the fastener is received in the opening. A ball is provided capable of partially protruding from the ball opening with the socket in an engaged state. A ball taper insert cams against the ball to push the ball into the ball opening. A spring biases the ball taper insert so as to urge the ball into the ball opening to engage the fastener. To disengage, a release mechanism pushes the ball taper insert against the spring so as to move the ball taper insert out of the way of the ball.

In preferred aspects, the ball taper insert moves in a direction parallel to an axis of the socket when it cams against the ball. Multiple ball openings and associated balls are provided around the periphery of the fastener receiving opening. The fastener receiving opening may advantageously be for a hex head fastener having six flat surfaces in a hex pattern and one ball opening is provided in each flat surface.

In preferred aspects, the release mechanism includes a plunger and an activation collar. The activation collar is rotatable relative to the socket body so as to move the ball taper insert against the spring when the collar is turned in one direction or allow the spring to move the ball taper insert toward the activation collar when the collar is turned in the opposite direction. The activation collar may include a ramp surface that slides against the plunger. The plunger may be separate from the insert and extend between the activation collar and the ball taper insert, and the ball taper insert and plunger may be movable in a channel formed in the socket body.

The activation collar may be movable axially between a normal position in which it is not rotatable relative to the socket body and a rotatable position in which it can be turned so as to release gripping of the fastener. A bayonet connection between the activation collar and the socket body may be provided that enables the activation collar to be turned after it is slid axially relative to the socket body. Preferably, springs on the plungers bias the plungers away from the ball taper inserts and bias the activation collar toward the normal position.

The invention also provides a wrench incorporating the inventive socket and a method of turning a fastener using it.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 10 is a view like FIG. 9 but in which the collar has been pushed down to enable turning the collar to a disengaged position;

FIG. 11 is a cross-sectional view from the plane of the line 11-11 of FIG. 10;

FIG. 12 is a view like FIGS. 9 and 10 but in Which the collar has been turned to the disengaged position;

FIG. 13 is a cross-sectional view from the plane of the line 13-13 of FIG. 12;

FIG. 14 is a cross-sectional view from the plane of the line 14-14 of FIG. 10;

FIG. 15 is a cross-sectional view from the plane of the line 15-15 of FIG. 12;

DETAILED DESCRIPTION OF THE PREFERRED EMBODIMENT

Figure 1:
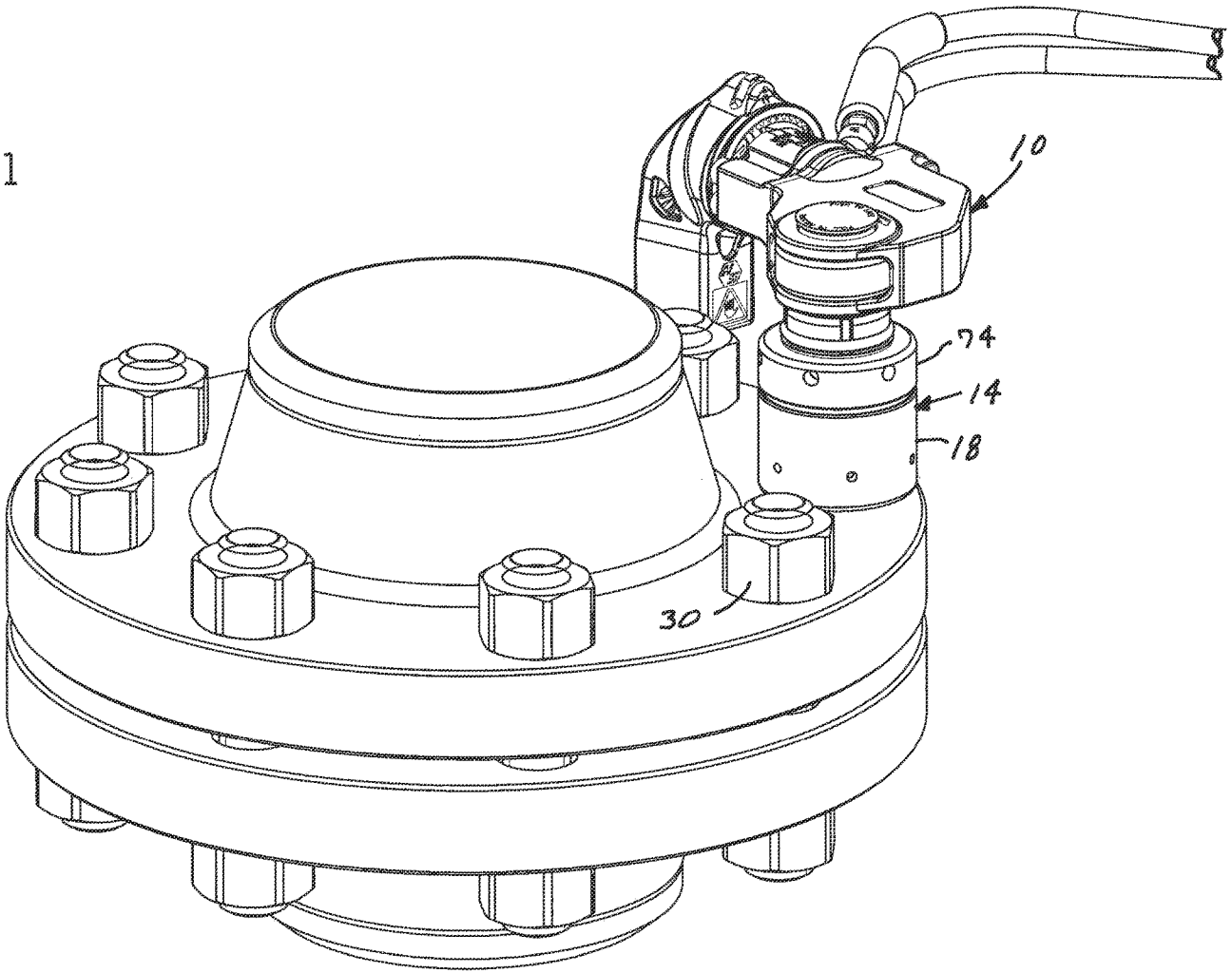
FIG. 1 is a perspective view of a hydraulic wrench and socket in engagement with a nut at the end of a bolted flange.
Figure 3:
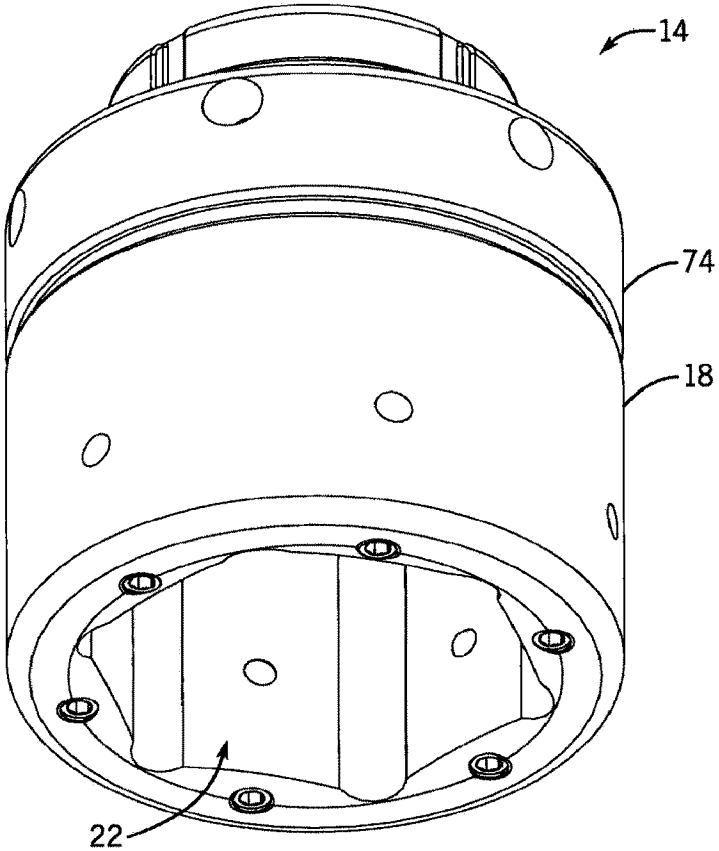
FIG. 3 is a bottom perspective view of the socket.
Figure 2:
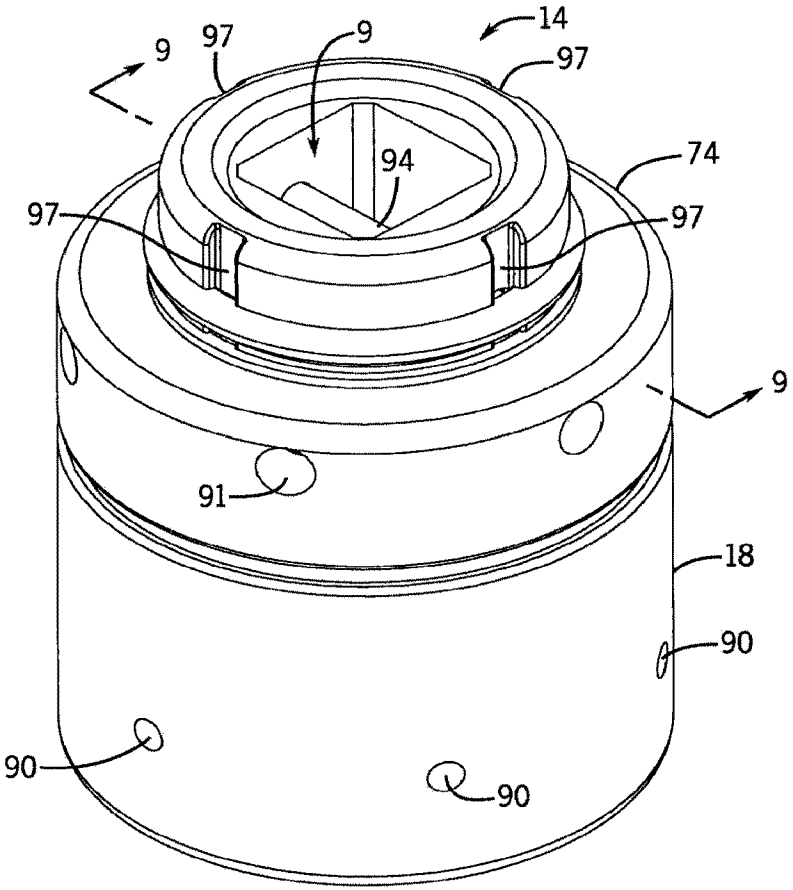
FIG. 2 is a top perspective view of the socket.
Figure 4:
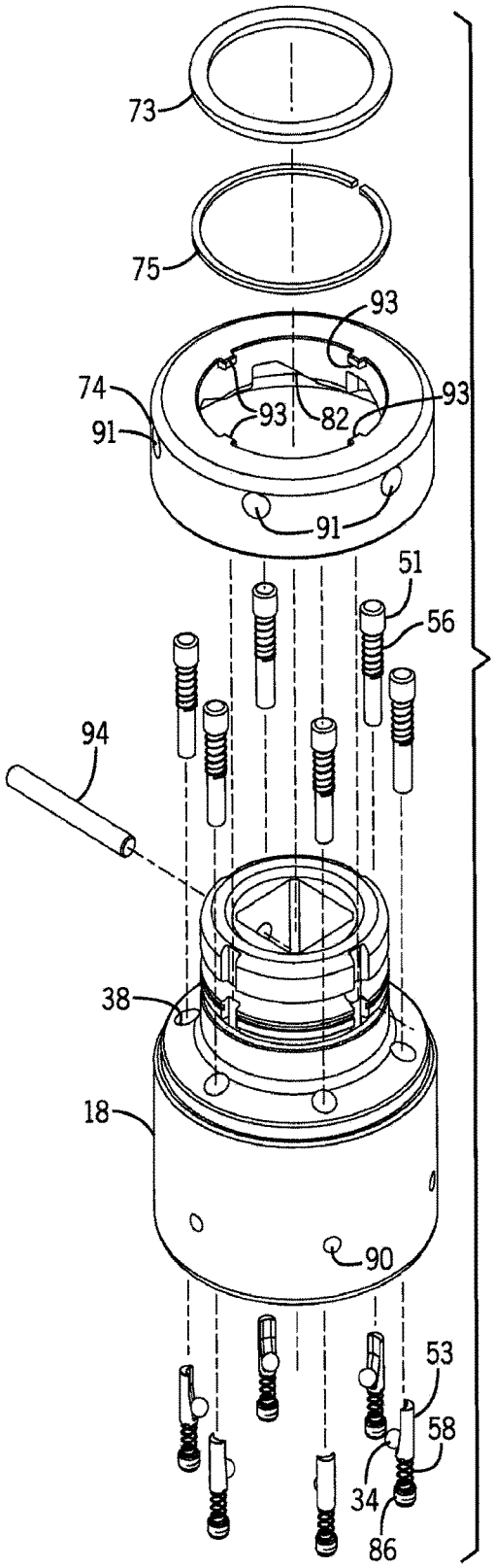
FIG. 4 is an exploded perspective view of the socket.

Referring to FIGS. 1-9, a hydraulic wrench 10 and socket assembly 14 is illustrated including a socket body 18 having a nut receiving opening 22, and gripping means in the socket body 18 for releasably grasping a fastener 30. Socket body 18 may be, for example, a modified impact socket. Socket body 18 has a universal square drive coupling hole 9 at its tool interface end that receives the square drive of a tool as is well known so as to be driven rotationally by the tool.

As shown in FIGS. 4-9, the gripping means is in the form of a ball mechanism 26 for releasably engaging the fastener 30, the mechanism 26 including a steel ball 34 received within a plunger channel 38 extending parallel to a longitudinal axis of the fastener 30, a ball receiving opening 42 extending between the plunger channel 38 and the fastener receiving opening 22, and urging means for releasably urging the ball 34 towards the fastener 30 received in the fastener receiving opening 22. The ball receiving opening 42 is sized slightly smaller than the ball 34, so that the ball 34 can pass only partially through the ball receiving opening 42.

The urging means includes a plunger 50 having a ball engaging ramp 54, the plunger 50 being received in the plunger channel 38, compression spring 58 for urging the plunger 50 and the bail 34 to a ball engaged position and a release mechanism 62 for engaging the plunger 50 and moving the plunger 50 to a ball disengaged position. The ramp 54 on the Plunger 50 allows movement of the ball 34 between the engaged position, under urging of the spring 56, and the disengaged position, when the plunger 50 is moved toward the fastener receiving opening by camming on a ramp 82 on the face of the collar 74 that is toward the fastener receiving opening 22.

In the preferred embodiment, the plunger 50 includes a top piece or ball plunger 51 and separate bottom piece or ball taper insert 53. The top piece 51 is inserted into the plunger channel 38 from the top, and the bottom piece 53 is inserted into the plunger channel from the bottom. The spring 58 biases the ball taper insert 53 upwardly, toward collar 74, so as to cause the ball 34 to cam on the ramp 54 and be pushed into the opening 42, to protrude partially therefrom and bear against the adjacent surface of the fastener 30 when the fastener is in the opening 22. Since there is one ball and associated remainder of the mechanism 26 for each of the six faces of a hex fastener (hex nut or bolt), they all act together to pinch or grasp the fastener between them. The ramp surface 54 of each insert 53 is of a shallow incline, so considerable pressure can be brought to bear against the surfaces of the fastener with relatively light force from springs 58, and the balls 58 cannot back out until the inserts 53 are moved into the release position (downwardly in FIG. 2) by the release mechanism 62.

The spring 58 extends between a set screw 86 in the plunger channel and the ball taper insert 53. The set screw 86 allows access to the plunger channel 38 so that the compression spring 58 can be placed in the channel 38 between the bottom piece 53 and the set screw 86. Another compression spring 56 is provided for each of the six ball plungers 51 that biases the ball plungers upwardly away from the inserts 53, and also biases the activation collar 74 in the same direction.

The socket body 18 has retaining pin openings 70 on opposite sides of the square drive hole at the top of the socket to aid in securing the socket assembly 14 to the square drive of a wrench 10, as is conventional. A retaining pin 94 extends through the openings 70 and is retained therein by a rubber o-ring 73.

In one embodiment, the release mechanism 62 includes activation collar 74 toward the end of the socket body opposite from opening 22. The collar 74 is received over a reduced diameter or indentation 78 on the exterior of the socket body 18. The collar 74 is held on the socket body 18 end by a snap ring 75 received in an annular grove 77. The rotatable collar 74 has a plurality (six in the embodiment illustrated) of ramps 82, one for each plunger 50, so that in one direction of rotation of the collar 74 (clockwise as viewed from the top of the socket, the collar ramps 82 engage the upper end of the ball plungers 51, moving the plungers 51 to a ball disengaged position. In the opposite direction, counter-clockwise, the tops of the plungers 51 cam on ramps 82 and are pushed axially toward the respective inserts 53 and when they engage the inserts 53, they push the inserts 53 downwardly, toward the fastener opening end of the socket body 18, and out of the way of the balls 34 to release the grip of the socket 14 on the fastener. The collar 74 can be provided with blind holes 91 in which one or more rods can be inserted to help push down and turn the collar 74.

The socket 18 further has an external ball entrance opening 90 perpendicular to and into the plunger channel 38, opposite the ball receiving opening 42. The external ball entrance opening 90 provides ball access to the plunger channel 38. When assembling the ball mechanism 26, the ball 34 is placed inside the socket 18 by passing the ball 34 through the external ball entrance opening 90, through the plunger channel 38, to the ball receiving opening 42. The plunger bottom piece 53 is then placed into the plunger channel 38, followed by the spring 58 and set screw 86 to hold the ball in the opening 42.

Figure 5:
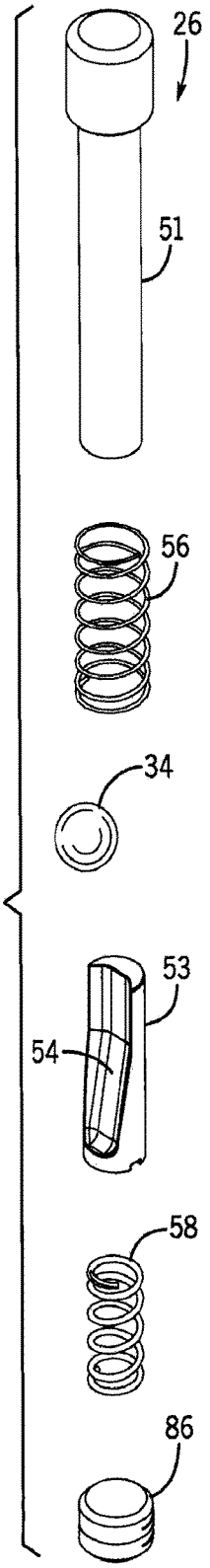
FIG. 5 is an exploded perspective view of a ball mechanism of the socket.
Figure 6:
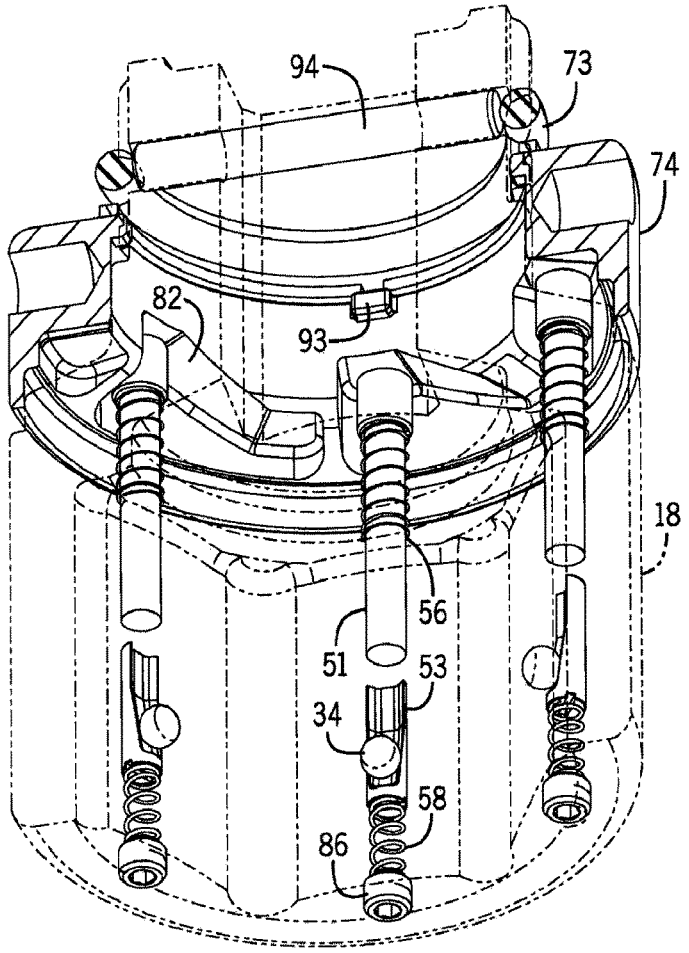
FIG. 6 is a fragmentary perspective view of the bottom of the collar of the socket and showing the socket body in phantom.
Figure 7:
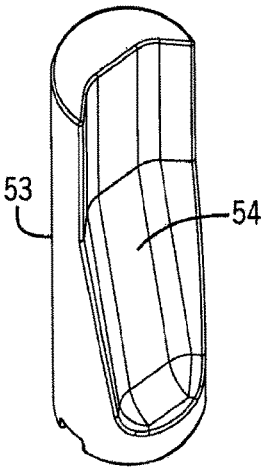
FIG. 7 is a perspective view of the ball taper insert of the ball mechanism.
Figure 8:
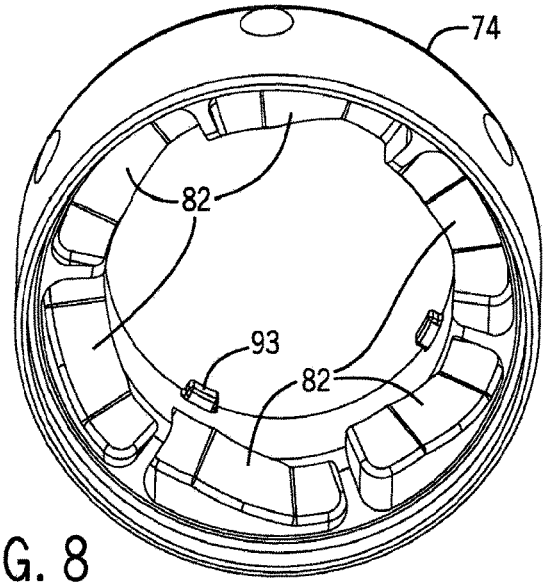
FIG. 8 is a bottom perspective view of the collar.
Figure 9:
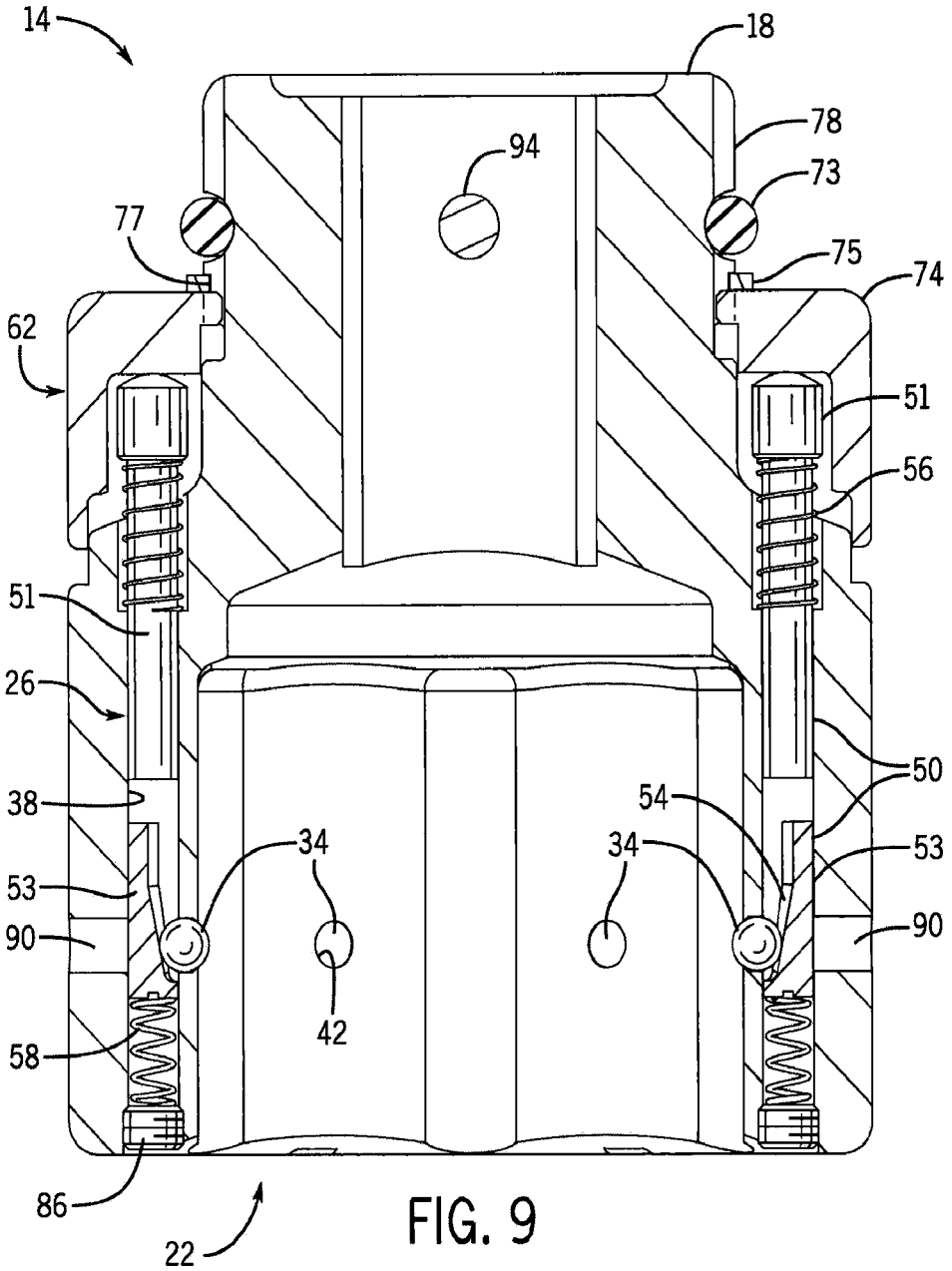
FIG. 9 is a cross-sectional view of the socket assembly in an engaged position.
Figure 16:
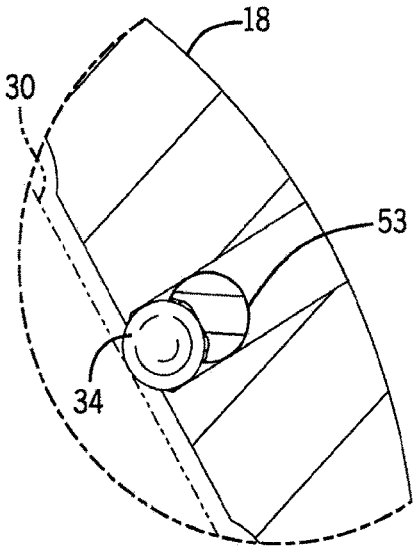
FIG. 16 is a detail view of the area of FIG. 14 indicated by line 16-16.
Figure 17:
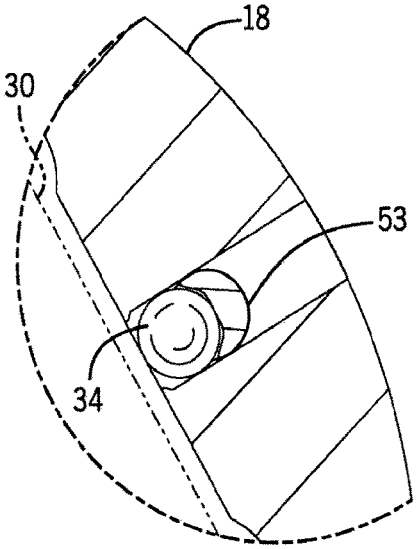
FIG. 17 is a detail view of the area of FIG. 15 indicated by line 17-17.

As described in the embodiment above, the socket assembly 14 includes a plurality of peripherally spaced apart ball mechanisms 26 in the socket 18, as shown in the drawings and described above, and the rotatable collar 74 includes a plurality of peripherally spaced apart ramps 82 in its lower surface, as shown in FIG. 5 and described above. The presence, in this embodiment, of a plurality of fastener engaging ball mechanisms, aids in the securing of the socket assembly 14 onto the fastener 30.

As described above, turning the collar in one direction cams the plungers 50 into a disengaged position in which the balls can move outwardly from the ball openings and turning the collar in the opposite direction cams the plungers to an engaged positioned in which the balls are forced into the openings. Normally, the collar is held in the angular position in which the balls are urged into the openings 42. This is accomplished by a bayonet connection between the collar 74 and the socket body 18. The bayonet connection is provided by tabs 93 (a total of four, but there could be more or less) that slide in a corresponding number of bayonet grooves 97. Each bayonet groove 97 is a right angle groove with one straight section parallel to the axis of the socket body 18 and another straight section, formed as part of an annular groove in the form illustrated, that continues perpendicularly from the bottom of the first section in the counter-clockwise direction as viewed from the drive or top end of the socket.

Therefore, to move the collar 74 from its normal, ball-engaged position (FIGS. 10, 11, 14 and 16) to its ball disengaged position (FIGS. 12, 13, 15 and 17), the operator first pushes the collar down until the tabs reach the bottom of the first section of the groove 97 and then turns the collar counter-clockwise, with the tabs 93 sliding in the second sections of the grooves 97. Turning the collar causes the plungers 51 to cam on the ramps 82 so as to be pushed toward the inserts 53, which causes the inserts 53 to slide toward the entry end of the opening 22 so as to move the ramps 54 away from the balls 34, to permit them to move out of the ball openings 42 thereby releasing the fastener.

Turning the collar 74 in the opposite direction (clockwise) cams the plungers 51 against the ramps 82 under the bias of the springs 56 causing the plungers 51 to move away from the inserts 53, permitting the inserts 53 to be cammed against the balls 34 under the urging of the springs 58, thereby moving the balls 34 into the ball openings 42 under force of the springs 58 and ramps 54. When the tabs become aligned with the first sections of the grooves 97, the collar 74 is pushed upwardly by the springs 56 so as to be held in the ball engaged angular position.

Figure 18:
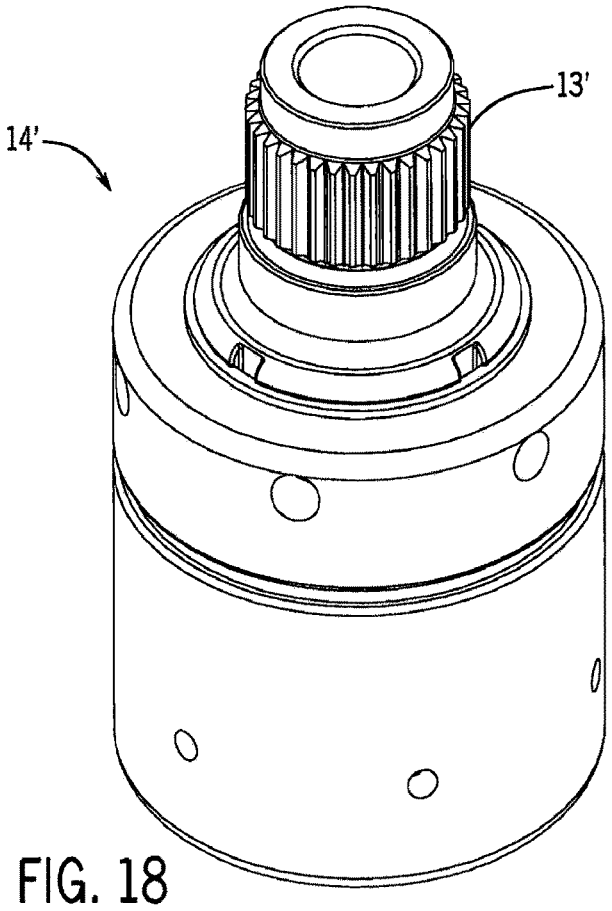
FIG. 18 is a top perspective view of an alternate embodiment of the socket assembly.

The embodiment 14' of FIG. 18 is the same as the first embodiment, except it has a spline extension 13' rather than a universal square drive coupling like the first embodiment 14. Whereas the universal square drive is made to be easily releasable, for example with the retaining pin 94 or sometimes simply a ball detent on the square drive of the wrench, the spline extension is made to be incorporated into and driven by the drive train of the wrench, and made a permanent part of the wrench, for example in a dedicated hydraulic wrench that can only turn one size fastener.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. A socket for engaging a fastener so as to drive the fastener rotationally, the socket having a gripping mechanism to help maintain the socket engaged on the fastener, the socket comprising:

a socket body having a fastener receiving opening sized and shaped to engage a fastener so as to drive the fastener rotationally;

at least one ball opening in the fastener receiving opening adjacent the fastener when the fastener is received in the opening;

a ball capable of partially protruding from the ball opening with the socket in an engaged state;

a ball taper insert that cams against the ball to push the ball into the ball opening;

a spring biasing the ball taper insert so as to urge the ball into the ball opening; and a release mechanism to push the ball taper insert against the spring so as to move the ball taper insert out of the way of the ball;

wherein the release mechanism includes a plunger and an activation collar, the activation collar is being rotatable relative to the socket body so as to move the ball taper insert against the spring when the collar is turned in one direction or allow the spring to move the ball taper insert toward the activation collar when the collar is turned in the opposite direction.

2. A socket as in claim 1, wherein the ball taper insert moves in a direction parallel to an axis of the socket when it cams against the ball.

3. A socket as claimed in claim 1, wherein multiple ball openings and associated balls are provided around the periphery of the fastener receiving opening.

4. A socket as claimed in claim 1, wherein the fastener receiving opening is for a hex head fastener having six flat surfaces in a hex pattern and one ball opening is provided in each flat surface.

5. A socket as claimed in claim 1, wherein the activation collar includes a ramp surface that slides against the plunger.

6. A socket as claimed in claim 1, including a plunger that extends between the activation collar and the ball taper insert.

7. A socket as claimed in claim 1, wherein the ball taper insert and the plunger are movable in a channel formed in the socket body.

8. A socket as claimed in claim 1, wherein the activation collar is movable axially between a normal position in which it is not rotatable relative to the socket body and a rotatable position in which it can be turned so as to release gripping of the fastener.

9. A socket as claimed in claim 8, wherein a bayonet connection between the activation collar and the socket body enables the activation collar to be turned after it is slid axially relative to the socket body.

10. A socket as claimed in claim 8, wherein a spring on the plunger biases the activation collar toward the normal position.

11. A socket as claimed in claim 8, wherein a spring biases the plunger away from the ball taper insert.

12. A socket as claimed in claim 1, wherein the socket body includes a square-drive opening opposite from the fastener receiving opening, the square-drive opening being for engaging a wrench.

13. A socket as claimed in claim 1, wherein the socket body includes a spline extension at an end opposite from the fastener receiving opening, the spline extension being for engagement with a drive of a wrench.

14. A wrench having a socket for engaging a fastener so as to drive the fastener rotationally, the socket having a gripping mechanism to help maintain the socket engaged on the fastener, the socket comprising:

a socket body having a fastener receiving opening sized and shaped to engage a fastener so as to drive the fastener rotationally;

at least one ball opening in the fastener receiving opening adjacent the fastener when the fastener is received in the opening;

a ball capable of partially protruding from the ball opening with the socket in an engaged state;

a ball taper insert that cams against the ball to push the ball into the ball opening;

a spring biasing the ball taper insert so as to urge the ball into the ball opening; and a release mechanism to move the ball taper insert relative to the release mechanism and against the spring so as to move the ball taper insert out of the way of the ball.

15. A wrench as claimed in claim 14, wherein the socket body has a square drive opening for engaging a square drive shaft of the wrench with a releasable coupling.

16. A wrench as claimed in claim 14, wherein the socket body has a splinted extension that is driven by the wrench.

17. A method of turning a fastener with a socket that is turned by a wrench when the wrench is operated, comprising the steps of:

moving a release mechanism of the socket to a disengaged position of the release mechanism in which the release mechanism moves a spring biased cam that is biased relative to the release mechanism out of the way of a ball of the socket so the ball moves out of the way to permit the socket to be placed over the fastener in rotational driving engagement with the fastener;

after placing the socket over the fastener, moving the release mechanism to an engaged position of the release mechanism in which the release mechanism moves out of the way to permit the spring biased cam to push a ball of the socket against a side of the fastener so as to interfere with the fastener;

operating the wrench to turn the fastener;

moving the release mechanism to the disengaged position; and removing the socket from the fastener.

18. A method of turning a fastener as claimed in claim 17, wherein a collar of the release mechanism is moved with a combination of axial and rotary motion between the engaged and disengaged positions.

* * * * *